United States Patent [19]

Dix

[11] 4,336,108

[45] Jun. 22, 1982

[54] CLOSURE ASSEMBLY FOR HORIZONTAL-CHAMBER COKING OVENS

[76] Inventor: Kurt Dix, Auf dem Knust 25, 4630 Bochum 1, Fed. Rep. of Germany

[21] Appl. No.: 218,203

[22] Filed: Dec. 19, 1980

[30] Foreign Application Priority Data

Dec. 21, 1979 [DE] Fed. Rep. of Germany ..... 2951682

[51] Int. Cl.[3] ..... C10B 25/06

[52] U.S. Cl. ..... 202/248

[58] Field of Search ..... 202/242, 241, 248

[56] References Cited

U.S. PATENT DOCUMENTS 3,984,310 10/1976 Calderon ..... 202/241

4,036,702 7/1977 Nagayoshi ..... 202/248

4,176,013 11/1979 Garthus et al. ..... 202/242

*Primary Examiner*—Norman Yudkoff

*Attorney, Agent, or Firm*—Karl F. Ross

[57] ABSTRACT

A horizontal-chamber coke oven having doorways at opposite ends, each of which extend substantially the full height of the chamber. The doorways are formed with door frames or jambs sealingly engaged by respective doors having door plugs which project into the chamber beyond the door frames or jambs. According to the invention, the side of the closure turned toward the oven chamber is provided with a flexible and yieldable seal which surrounds a hot frame or heat-retentive body such that the temperature in the region of the closure door during filling of the chamber and coking is held above the condensate-forming temperature.

11 Claims, 9 Drawing Figures

CLOSURE ASSEMBLY FOR HORIZONTAL-CHAMBER COKING OVENS

FIELD OF THE INVENTION

My present invention relates to a horizontal-chamber coking furnace with doors at opposite ends of each coking chamber and, more particularly, to improvements in the sealing of the door openings of such coke-oven chambers.

BACKGROUND OF THE INVENTION

In coke ovens it is known to provide a battery of horizontal coke-oven chambers each of which can have a height considerably greater than the width and which can be provided at opposite ends with doors or closures which are sealed in the respective doorways by a variety of means. Reference may be had to The Making, Shaping and Treating of Steel, pages 119ff, U.S. Steel Co., Pittsburgh, Pa., 1971.

The doorways of such horizontal coking chambers have closures at opposite ends which can comprise doors which sealingly engage and latch against the continuous door jambs extending around and framing such openings. The doors, moreover, are provided with door plugs which project into the furnace chambers.

Between the door, door plug and door frame, a gas collecting space or passage is formed whereby gases remaining from the coking process and sealed from the atmosphere may be withdrawn.

Fine coal may be coked in horizontal-chamber coking ovens by indirect heating, thereby generating significant quantities of gas. This gas seeks to escape into the atmosphere through the closures or doors at the ends of the chamber, especially immediately following the filling thereof with coking coal substantially to the height of the closures.

There have been numerous proposals seeking to seal the doors so tightly that a minimum of the generally toxic or noxious gases can escape. It should also be noted that such gases are easily combustible and result in problems within the coke oven on this ground as well.

The sealing means generally provide metal-to-metal contact between the closure or door and the door frame.

While such metal-to-metal seals have the advantage of heat resistance, they are not always satisfactory for coke oven purposes since it is not always possible to bring about the requisite good surface-to-surface contact between the sealing members.

Any failure of the seal can result in gases escaping into the atmosphere. Environmental protection requirements mandate that such escape be excluded or minimized and considerable effort has been invested in designing metal-to-metal seals for this purpose. Reference may be had in particular, to U.S. Pat. No. 1,065,370, to German patent document DE-as No. 1,017,590 and to German patent document DE-p No. 24,593.10 aD.

In all of these closure systems, however, the escape of gas from the coking chamber into the atmosphere cannot be completely foreclosed and, in addition, considerable expense and labor must be expended on cleaning the sealing surfaces because tar and graphite condensates tend to accumulate thereon.

While manual cleaning has been practiced for a long while, in recent years efforts have been made to substitute mechanical cleaning. Mechanical cleaning, however, has been found to be less than fully effective in removing accumulations of contaminants from corner regions of the door frame and the door.

One of the problems which arises is due to the fact that conventional metal-to-metal seals require a condensate film for most effective formation of a hermetic barrier. This condensate film tends to form as a result of the pressure fluctuations in the coking oven which can cause a pressure drop such that a precipitation of condensate occurs in the sealing regions. During this pressure drop the sealing members cooled spontaneously, rapidly and to a lower temperature than other parts of the oven, thereby resulting in preferential formation of the condensate film.

After the closure member, i.e. the coke oven door, is set into the door opening and after filling of the chamber with the coking coal, condensate precipitates upon the sealing surfaces until these regions are again brought to a high temperature by the coking process.

It has been found to be a drawback of such systems that the formation of the condensate cannot be controlled. In the region of the bottom of the door, for example, and immediately thereabove, the amount of condensate which forms is excessive, i.e. far more than is necessary to form the sealing film.

On the other hand, in upper regions of the door, the condensate formation may be insufficient to form the requisite film.

At the regions to which there is excess uniform condensate formation, the sealing of the chamber may be more difficult and contamination can occur to a significantly greater degree requiring excessive cleaning.

OBJECTS OF THE INVENTION

It is the principal object of the present invention to provide an improved closure system for a coke-oven chamber of the type described whereby the disadvantages of prior art systems may be obviated.

Another object of this invention is to provide a sealing-type closure for coke ovens, especially a selfsealing door for a coke-oven chamber, in which condensate formation and graphite deposits are reduced, especially at the sealing surfaces.

SUMMARY OF THE INVENTION

These objects and others which will become more readily apparent hereinafter are retained, in accordance with the present invention, by providing on the side of the closure, i.e. the door, turned toward the interior of the coking chamber, which is provided with a flexible and yieldable seal, a hot body or member which retains a temperature above the condensate formation temperature during the filling of the chamber and the stages prior to complete coking of the charge within this chamber.

The heat capacity of this body, which can extend around the door and can lie inwardly of the yieldable sealing members, should be such that it can pick up sufficient heat during the coking process that it will retain its temperature until the high temperature portion of the coking process is again reached with a subsequent charge.

Thus, during a preceding coking process, the hot body (heat-retentive frame) is heated to a temperature well above the condensate-forming temperature or dew point of the gases evolved from the coking coal, and remains at this temperature or within a temperature range above the condensate-forming temperature such that, upon outward swinging of the coke oven door, the discharge of coke from the chamber, the return swing of the door to its closed position and the filling of the coking chamber with coking coal, the temperature of the hot body and the regions of the closure therearound is sufficient to preclude condensation from the coke-oven gases on the closure members of the door.

After the door is closed, this body heats the surrounding areas of the frame and the gas-collecting space or passage, with sufficient radiant energy that these elements also remain free from condensate formation.

This system has the additional advantage that gases entering this region automatically are diverted upwardly through the gas-collection chamber and can be withdrawn at the top thereof. Escape of these gases is thereby precluded.

The flexible and yieldable seal thus provides an additional safety function in that it limits any residual gases in the collection compartment from escaping to the atmosphere. Various types of flexible seals can be used.

To protect the hot body against damage by auxiliary implements such as the leveling bar, and to provide additional gas collection space thereby increasing the sealing efficiency, it has been found to be advantageous to provide the hot body in a recess around the door plug in the door frame. The recess and the hot body have configurations such that, in cross section, the gas collection space has two substantially right angle gas collection regions. As a result the gas collection space itself has a greater cross section than one having a single 90° gas collection region and an improved chimney effect is ensured so that the greatest part of the coke-oven gas in the gas-collection region rises readily.

So that the hot body will have the necessary heat capacity and be capable of radiating heat inwardly after the door has been swung back into place, the hot body or frame is formed by hollow members filled with a material having high heat-storage and good heat-radiating properties. The walls of the hot frame should be as thin as possible, i.e. minimum wall thickness, to minimize resistance to the passage of heat therethrough and to limit the loss of heat in the open-door positions. The material of high heat-storage capacity and good heat-radiating effect can be a ceramic or a ceramic-like material.

To maximize the cross section of the gas collection space and thereby improve the chimney effect, the hot frame is set outwardly from the door plug, i.e. is spaced therefrom.

This is made possible by making the hot frame narrower and deeper relative to the recess of the door frame or by correspondingly enlarging the recess. The enlargment of the gas-collection space in this sense has the advantage that no constriction in a gas section in the region of the level-bar hole need be provided. It is also possible to maximize the cross section of the gas collection space by disposing the hot frame or body so that it projects ahead of the sealing surface of the door frame.

It has been found to be advantageous, moreover, to increase the temperature range in the gas-collection region ahead of the flexible seal by providing the outer surface of the hot frame or body so that it is overhung or covered 50% or less by the mounting member of the closure.

The main radiation should, however, be detected from the first angled portion of the gas-collection space inwardly toward the space as can be achieved in a highly advantageous manner by providing the outer surface and one of the lateral surfaces or flanks of the hot body or frame so that it is enclosed by pincer-like formations on the mounting member of the closure. These pincer-like portions of the mounting member can form the outer surface and lateral surface of the hot body and can be connected to a thin-wall angle iron which encloses the heat storage material.

The other surface and lateral surface can be formed from any grey cast iron or a similar material while the two other materials, i.e. the inner surface and the outer lateral surface are formed from the thin-wall angle iron. The radiation preferentially is effected from the thin wall angle iron so that an upward movement of the gases is promoted and condensate in the interior region does not tend to form.

The cleaning of the door opening and closure is facilitated especially at the bottom regions thereof, by forming the bottom member of the hot frame, which is bounded by the inclined bottom of the door frame, formed as a right triangle in a profile with one of its acute-angle vertices pointing downwardly. The bottom of the door frame or sill and the bottom member of the hot body thus are substantially complementary, thereby allowing the cleaning tools to slide into place readily along the inclined surface and ensuring that practically no residues will remain in the furnace. The closing of the door is not prevented by any coke residues on the floor of the furnace.

It also has been found to be advantageous to limit the passage of the gas to the flexible seal and to increase the chimney effect in the gas-collection chamber by reducing the gas section of the gas collection space from the interior to the exterior.

I have also found it to be possible to control the flow direction of the gases generated during the coking process by providing the gas collection region over the height of the door frame with one or more ribs which can advantageously be mounted on the hot body and can be inclined upwardly and inwardly, these ribs projecting two slots in the door frame.

In this manner and by so modifying the shape of the gas-collection compartment the extraction of the gas can be concentrated at a particular zone of the gas collection space thereby again limiting condensate formation and limiting or preventing access of the gases to the flexible seal.

The system described of the present invention has the important advantage that condensate formation in the region of the closure is reduced or precluded entirely, thereby eliminating or reducing maintenance and cleaning-down time and the associated costs. The need to replace the seals is postponed as well. The gas-type closure of the oven chamber during a comparatively large number of coking cycles is assured reliably without loss of effectiveness of the sealing surfaces by condensate and graphite deposition.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
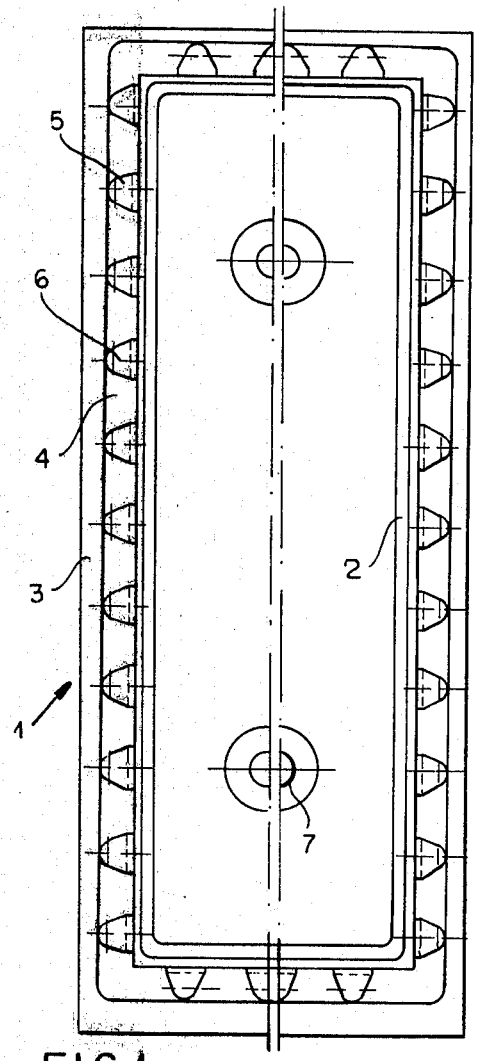
FIG. 1 is an elevational view of a coke-oven chamber closure seen in partly diagrammatic form.

In the drawing I have shown the closure (FIGS. 1 through 3) at one end of a horizontal coke oven, details of which have not been illustrated but which can be of the type described in the aforementioned publication, operating with the usual pusher, filling larry and leveling bar arrangement.

The closure assembly 1 comprises, as is customary, a closed metal frame 3, hereinafter referred to as the door frame and which is mounted on the body of the furnace surrounding a doorway or opening through which the coke can be discharged or the coke pressure introduced into the oven.

The closure also includes a door body 2 of grey or spherolytic cast iron and a peripheral seal 4 mounted upon the door.

In FIG. 1 the closure 1 is seen in a front elevational view to comprise a peripheral sealing bar 4 which is mounted upon a thin-plate membrane 4*a* (FIG. 3) on the door body 2 and urged by a set of spaced apart springs 5 against the sealing surface 8 of the frame 3 in the closed position of the door. The latch bar assembly is represented at 7 in FIG. 2 and can comprise a latch bar 28 engageable in hooks 27 of the door frame and urged outwardly by a stack 29 of Belleville washers forming dished-disk springs. The spindle 50 of the latch bar 28 has been represented only diagrammatically.

The door body has, on its side turned toward to open chamber, a hot frame or body 15 which, in the closed position of the assembly, is received in a recess 24 of the door frame 3.

At the bottom of the door frame 3, at which its inner surface 12 is flush with the floor of the furnace, the frame forms a downwardly inclined sill 13 which is complementary to the inclined flank 51 of the bottom member 16 of the hot frame. The bottom member 16 of the hot frame is a right angle triangular profile having one of its acute angle vertices 17 turned downwardly.

Figure 2:
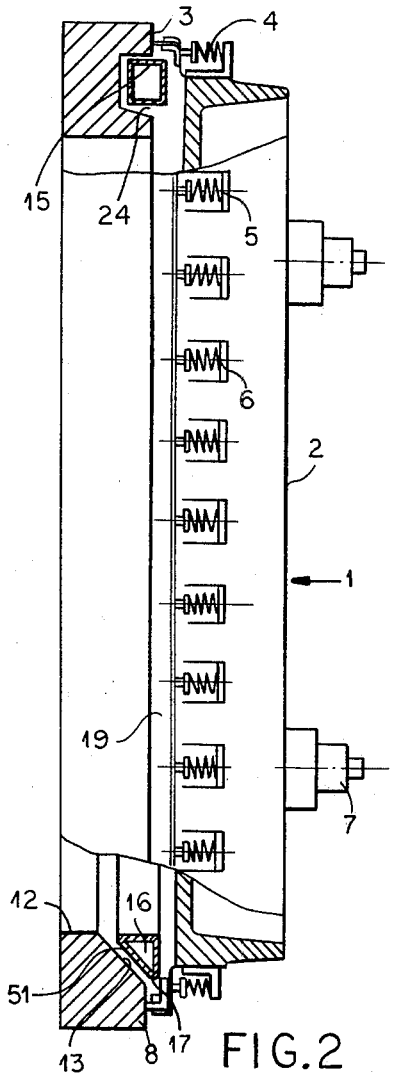
FIG. 2 is a side elevational view, partly broken away of the closure of FIG. 2.
Figure 3:
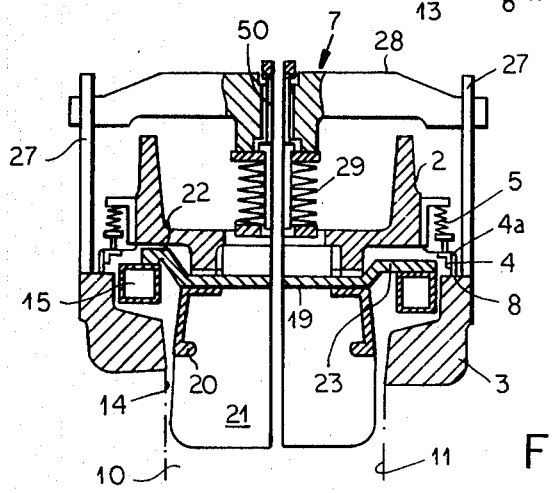
FIG. 3 is a section through the closure taken in a horizontal plane.

From FIGS. 2 and 3 it will be apparent that, in the closed position of the assembly the door carries a plug 21 which fits into the oven chamber 10 between the walls 11 thereof so that a space or passage 14 is formed between the plug and these wall enabling gas to pass into the gas collecting compartment of the closure. The plug 21, e.g. of ceramic, is secured to the door body 2 by holders 20.

Figures 4A, 4B:
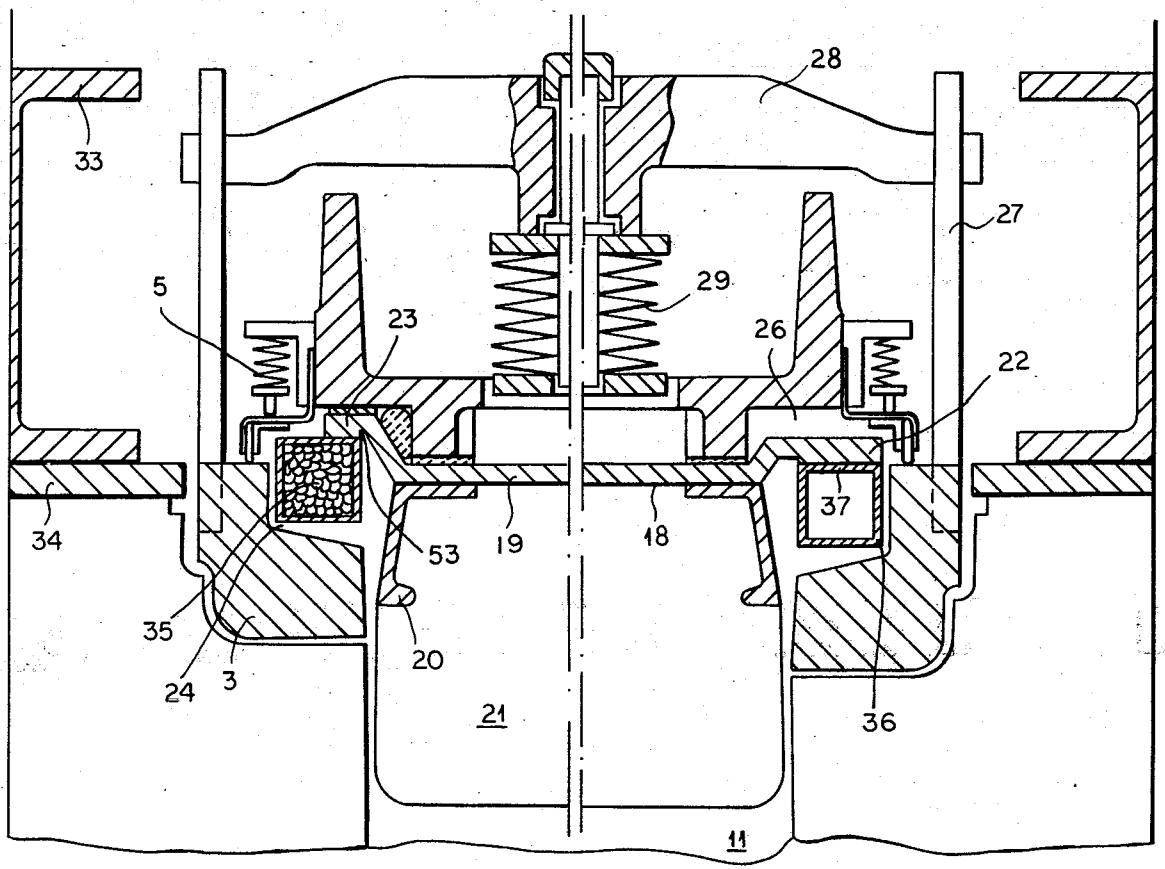
FIGS. 4*a* and 4*b* show portions of the closure of FIG. 3 drawn to a larger scale and in greater detail, illustrating two different mounting arrangements of the hot body or frame of the instant invention.

The wall 19 of the door body 2 is extended by flanges 22 or 23 (see FIGS. 4*a* and 4*b*) to which the hot frame 15 can be secured. In the embodiment of FIG. 4*b* the hot frame is secured to the entire outer surface 37 of flange 22 although in the embodiment of FIG. 4*a* the hot frame is secured to only a portion (50% or less) of the outer surface 53 of the flange 22. The hot frame is formed as a hollow body 36 in which a material of high heat capacity, such as the ceramic particles 35, can be deposed.

The latches 7 are flanked by channel-shaped members 33 which abut the wall-protecting plates 34 facing the exterior of the oven.

Figures 5A, 5B:
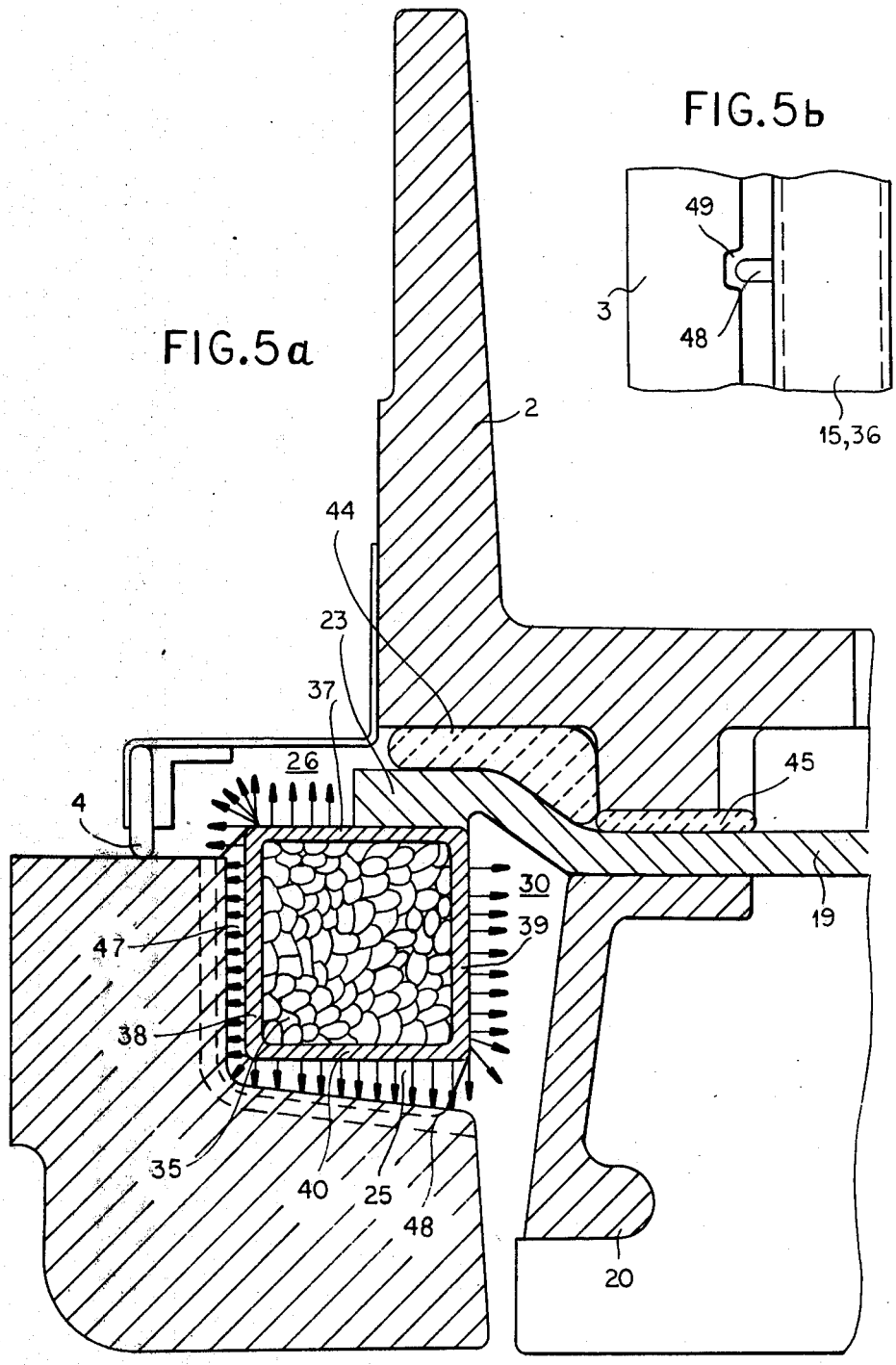
FIG. 5*a* is a detail view of a system similar to that of FIG. 4*a* illustrating another feature of the invention.
FIG. 5*b* is a side elevational view of a portion of the embodiment of FIG. 5*a*.

FIG. 5*a* shows a detail of the construction of FIG. 4*a* in which arrows have been provided to show the heat radiation pattern. The hollow body 36 filled with the material 35 of high heat capacity and heat radiating effect, radiates heat into gas collection space 30 and into the gas collection space 25 which, in cross section, turns through two 90° angles, ending in a gas space 26 in the direct vicinity of the flexible seal 4.

The formation of condensate in all of these regions is precluded or limited as is the formation of graphite deposits.

The gas collection 30 has a substantially larger cross section than the gas collection spaces 25 and 26, the latter decreasing in cross section in the direction of the gas collection space 26.

The draw in the gas collection space 25 is influenced as well by ribs 47 and 48 which project into grooves 49 in the door frame. These ribs are inclined upwardly and inwardly, i.e. upwardly and toward the gas collection member 30.

The automatic rise of gas by the chimney effect thus tends to bring the gas back into chamber 30.

The hot body 15 has an outer surface 37, lateral surfaces 38 and 39, and the inner surface 40, all of which can be relatively thin walled so as to minimize barriers to heat transfer.

As can be seen from FIG. 5*a*, the gas region 26 receives little if any gas so that the flexible seal 4 merely forms an additional barrier against the passage of gas to the outside. Any gases which do manage to collect in the region 26 are so heated or are above to retain the heat, that they pass upwardly rapidly and are withdrawn. To protect the door body 2, between the bracket or mounting member 23 and the door body 2, members 44 and 45 of thermally insulating material are provided. The use of this material further limits the cross section of the gas-collecting region and the region over which the hot frame 15 must be effective.

Figures 6A, 6B:
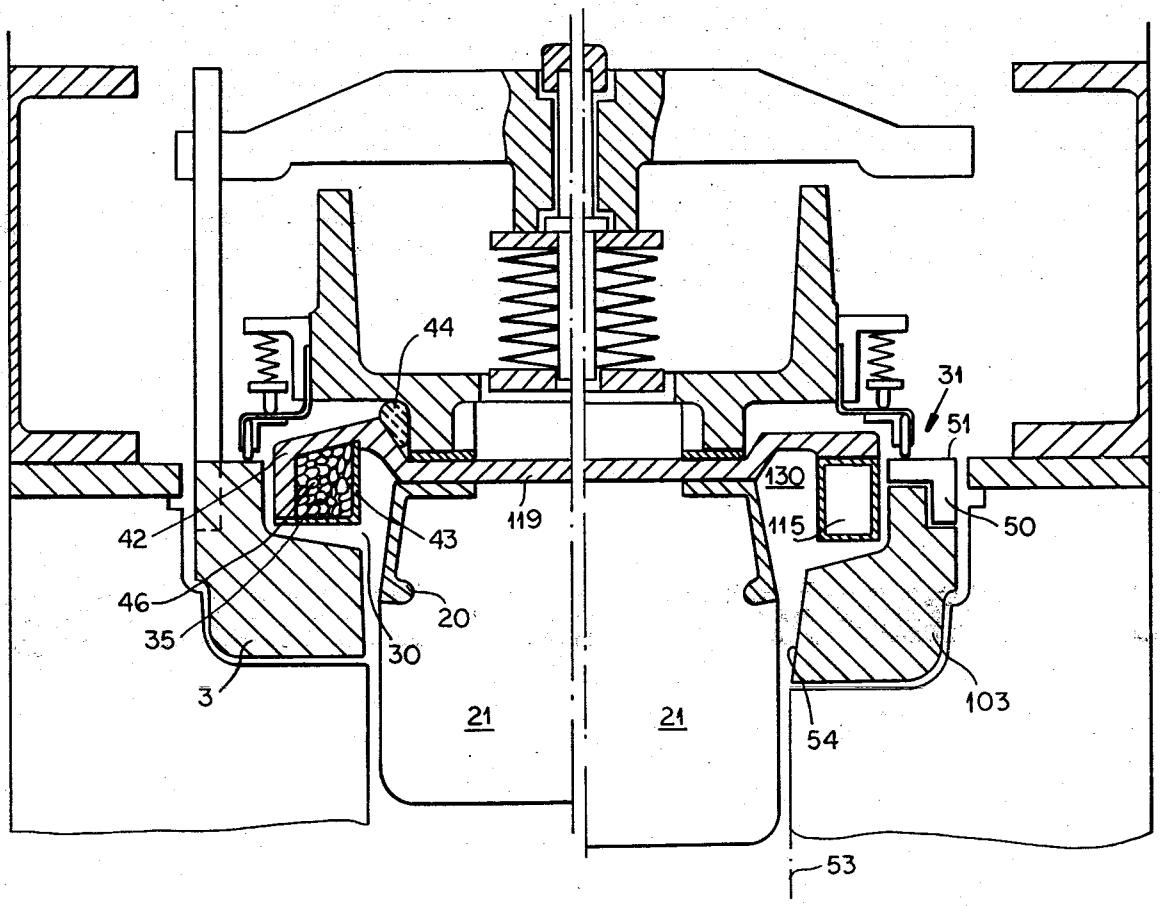
FIGS. 6*a* and 6*b* are partly similar to FIGS. 5*a* and 5*b* illustrating other embodiments of the invention.

FIGS. 6*a* and 6*b* show additional embodiments of a hot frame according to the invention. In FIG. 6*a*, the door member 119 has a fork shape with projections 46. The fork or pincer part of the bracket 42 forms the outer and lateral surfaces of the hot body or frame while the two surfaces turned toward the gas-collecting region 30 are formed by an angle iron 43 which is thin, is packed with heat storage material and which is connected by the projections 46 with the bracket 42.

The gas-collection region 130 in the embodiment of FIG. 6*b* can be increased in size by making the hot frame 115 narrower and/or by setting back the hot frame from the wall 53 of the chamber or from the plug 21. The door frame 103 has an additional frame member 50 whose surface 51 is engaged by the flexible seal 31. The door frame 103 also has an inclined surface 54 which likewise contributes to an increase in the gas section of the gas-collection region 30.

I claim:

1. A closure for a horizontal coke oven comprising:

a door frame adapted to surround an opening at the end of a coking chamber;

a door shiftable to open and close said opening and adapted to be latched relative to said door frame, said door being formed with a door plug passing with clearance through said door frame in a closed position of the door and fitting into said opening;

a flexible seal on said door engaging said door frame whereby said door and said frame form a gas-collection space inwardly of said seal; and a hot body mounted on said door and disposed in said space and of a heat capacity sufficient to maintain the temperature in the region of said space during filling of said chamber and coking therein above the condensate forming temperatures, said hot body being a thin-wall hollow hot frame of rectangular cross section surrounding said plug and received at least in part in an L-shaped recess of said door frame, to define in said space a gas-collection passage having two right-angle bends in cross section, said hot frame being filled with a material of high heat-storage capacity and heat-radiating effectiveness.

2. The closure defined in claim 1 wherein said hot frame is spaced outwardly from said plug.

3. The closure defined in claim 1 wherein said hot frame projects inwardly beyond said seal.

4. The closure defined in claim 1 wherein said door is provided with a mounting surface, said hot frame being connected to said mounting surface, said hot frame having an outer face covered to at most 50% of its area by said mounting surface.

5. The closure defined in claim 1 wherein said hot frame is formed at least in part by a mounting member on said door defining an outer surface and a lateral surface of the hot frame.

6. The closure defined in claim 8 wherein said hot frame further comprises a thin-wall angle iron defining said hot frame with said mounting member and forming therewith a space filled with heat-storage material.

7. The closure defined in claim 1 wherein said hot frame includes a bottom member containing a sill of said door frame, said sill being inclined downwardly and outwardly, said bottom member being of a right triangle cross section having a vertex turned downwardly.

8. The closure defined in claim 1 wherein said hot frame and said recess are shaped so that the cross section of said passage decreases from the interior outwardly.

9. The closure defined in claim 1, further comprising at least one rib deflecting gas flowing upwardly through said passage.

10. The closure defined in claim 12 wherein said rib is mounted on said hot frame and extends into a groove form on said door frame.

11. The closure defined in claim 1 wherein said door frame is provided in two parts, one of said parts being formed with said recess, the other of said parts being engaged by said seal.

* * * * *